US008876460B2

(12) United States Patent
Willett, Jr.

(10) Patent No.: US 8,876,460 B2
(45) Date of Patent: Nov. 4, 2014

(54) METHOD AND APPARATUS FOR MEASURING TURBINE SHELL CLEARANCE

(75) Inventor: Fred Thomas Willett, Jr., Burnt Hills, NY (US)

(73) Assignee: General Electric Company, Schenectady, NY (US)

( * ) Notice: Subject to any disclaimer, the term of this patent is extended or adjusted under 35 U.S.C. 154(b) by 526 days.

(21) Appl. No.: 13/207,536

(22) Filed: Aug. 11, 2011

(65) Prior Publication Data

US 2013/0039743 A1 Feb. 14, 2013

(51) Int. Cl.
*F01D 25/24* (2006.01)
*F01D 21/00* (2006.01)
*F01D 11/00* (2006.01)

(52) U.S. Cl.
CPC ..... *F01D 25/243* (2013.01); *F01D 21/003* (2013.01); *F01D 11/001* (2013.01)
USPC ..... 415/1; 415/118; 416/61; 29/889.21

(58) Field of Classification Search
CPC ..... F01D 11/08; F01D 11/14; F01D 11/20; F01D 11/22; F01D 25/285; F01D 25/34
USPC ..... 415/118, 133, 173.1, 173.2, 173.6, 415/174.1, 1; 416/61; 29/889.2, 889.21
See application file for complete search history.

(56) References Cited

U.S. PATENT DOCUMENTS 3,869,800 A * 3/1975 Bartlett et al. ..... 33/504
4,063,167 A * 12/1977 Duly ..... 324/671
4,071,820 A * 1/1978 Mushinsky ..... 324/671
4,199,718 A * 4/1980 Ikeda et al. ..... 324/765.01
4,596,952 A * 6/1986 Goff et al. ..... 324/207.25
4,813,273 A 3/1989 Parsons
4,818,948 A 4/1989 Dooley
4,987,555 A * 1/1991 Twerdochlib ..... 702/158
5,140,494 A 8/1992 Slade
5,166,626 A * 11/1992 Hester et al. ..... 324/690
5,203,673 A 4/1993 Evans
5,319,922 A 6/1994 Brantley
5,385,013 A 1/1995 Barron et al.
5,497,101 A * 3/1996 Fillion ..... 324/662
5,513,539 A 5/1996 McLaughlin et al.
5,627,761 A * 5/1997 Pollard ..... 700/279
6,575,011 B1 6/2003 Busby et al.
6,665,589 B2 * 12/2003 Steingraeber ..... 700/279
6,717,418 B2 4/2004 Orenstein
7,180,305 B2 2/2007 Andarawis et al.
7,215,129 B1 5/2007 Andarawis et al.

(Continued)

*Primary Examiner* — Igor Kershteyn
*Assistant Examiner* — Wayne A Lambert
(74) *Attorney, Agent, or Firm* — Ernest G. Cusick; Hoffman Warnick LLC

(57) ABSTRACT

An apparatus for measuring turbine rotor-to-stator clearances and a method for assembling a turbomachine based on the measured clearances are disclosed. In an embodiment, at least one clearance sensor is inserted into a stator of a turbomachine. Using the sensor, tops-on clearance between a rotor blade tip and an inner surface of a stator is measured while an upper stator shell, a rotor, a lower stator shell are assembled together; and a tops-off clearance is measured while the lower stator shell and a rotor are assembled together. A tops-on/tops-off shift, i.e., a difference between the tops-on clearance and the tops-off clearance, is determined. The turbine can be assembled by adjusting a relative position of the rotor and stator to account for the tops-on/tops-off shift.

3 Claims, 8 Drawing Sheets

(56) References Cited

U.S. PATENT DOCUMENTS

| | | | | |
|---|---|---|---|---|
| 7,332,915 | B2 | 2/2008 | Andarawis et al. | |
| 7,333,913 | B2 * | 2/2008 | Andarawis et al. | 702/158 |
| 7,404,331 | B2 | 7/2008 | Ruud et al. | |
| 7,466,143 | B2 | 12/2008 | Andarawis et al. | |
| 7,489,811 | B2 * | 2/2009 | Brummel et al. | 382/152 |
| 7,540,704 | B2 | 6/2009 | Shang et al. | |
| 7,652,489 | B2 | 1/2010 | Dasgupta et al. | |
| 7,688,081 | B2 | 3/2010 | Webster | |
| 7,722,310 | B2 | 5/2010 | Balasubramaniam et al. | |
| 7,775,107 | B2 | 8/2010 | Holmquist | |
| 7,785,063 | B2 | 8/2010 | McQuiggan et al. | |
| 7,852,092 | B2 | 12/2010 | Andarawis et al. | |
| 7,853,427 | B2 | 12/2010 | Chan et al. | |
| 7,891,938 | B2 * | 2/2011 | Herron et al. | 415/1 |
| 2005/0286995 | A1 * | 12/2005 | Shang et al. | 415/1 |
| 2006/0132147 | A1 * | 6/2006 | Balasubramaniam et al. | 324/662 |
| 2006/0239813 | A1 | 10/2006 | Shah et al. | |
| 2009/0003991 | A1 | 1/2009 | Andarawis et al. | |
| 2009/0243628 | A1 | 10/2009 | Andarawis | |
| 2010/0077830 | A1 | 4/2010 | Andarawis et al. | |
| 2010/0188100 | A1 | 7/2010 | Andarawis et al. | |
| 2010/0191502 | A1 | 7/2010 | Ren et al. | |

* cited by examiner

METHOD AND APPARATUS FOR MEASURING TURBINE SHELL CLEARANCE

BACKGROUND OF THE INVENTION

The disclosure relates generally to turbo-machines such as steam and gas turbines, and more particularly, to an apparatus and method for measuring deflection between rotating turbine blade tips and their surrounding casing.

Turbomachines, such as gas and steam turbines, typically include a centrally-disposed rotor that rotates within a stator. A working fluid flows through one or more rows of circumferentially arranged rotating blades that extend radially outward from the rotor shaft. The fluid imparts energy to the shaft, which is used to drive a load such as an electric generator or compressor.

Clearance between radially outer tips of the rotating blades and stationary shrouds on an interior of the stator in, e.g., compressor and turbine sections of gas turbines strongly impacts efficiency of the gas turbine engine. The smaller the clearance between the rotor blades and the inner surface of the stator, the lower the likelihood of fluid leakage across blade tips. Fluid leakage across blade tips causes fluid to bypass a row of blades, reducing efficiency.

Insufficient clearance may also be problematic, however. Operating conditions may cause blades and other components to experience thermal expansion, which may result in variations in blade tip clearance. The specific effects of various operating conditions on blade clearance may vary depending on the type and design of a particular turbomachine. For example, tip clearances in gas turbine compressors may reach their nadir values when the turbine is shut down and cooled, whereas tip clearances in low pressure steam turbines may reach their nadir values during steady state full load operation. If insufficient tip clearance is provided when the turbomachine is assembled or re-assembled after inspection/repair, the rotating blades may hit the surrounding shroud, causing damage to the shroud on the stator interior, the blades, or both when operating under certain conditions.

During turbine assembly and re-assembly after inspection/repair, the lower stator shell is typically assembled first, then the rotor is set in place. Then the upper stator shell is assembled, including affixing the upper shell to the lower shell of the stator as shown in FIG. 1. This may typically be done by, e.g., bolting arm 222 of upper stator shell 220 to arm 242 of lower stator shell 240 together in a horizontal joint 230.

Although rotor-to-stator clearances can be measured in the lower half prior to assembling the upper half (i.e., in the "tops-off" condition, see FIG. 4), these values are not directly representative of the values in the fully assembled turbine (i.e., in "tops-on" condition, see FIG. 3) because the turbine shell is supported differently when the upper shell 220 of the stator is affixed to the lower shell 240. In the tops-on condition, support is shifted from the lower shell arm 242 to the upper shell arms 222, the weight of the upper shell 220 of the stator is added, and when the horizontal joint 230 is bolted, the overall stator 200 structure stiffens. As a result of these and other changes, the rotor-to-stator clearance is different in the tops-on and tops-off conditions, by a factor which may not be readily predictable. In the tops-on condition, in which the turbomachine is operated, clearances cannot be measured directly, since the turbomachine is fully assembled, and the rotating blades and inner surface 210 of stator 200 are not accessible.

One way the tops-on/tops-off shift has been addressed has been to use clearances between the rotating blade tips and the inner surface of the stator that are sufficiently large as to include the tops-on/tops-off deviation. For reasons discussed above, however, this is detrimental to turbomachine performance and efficiency because it is likely to result in excessive clearances and leakage of working fluid across blade stages.

Another approach has been to use factory tops-on/tops-off data in the field. However, this presents a data management problem, as factory data may be taken years before the turbomachine is disassembled in the field and must be reassembled. Differences in conditions between the factory and the field further complicate this approach.

BRIEF DESCRIPTION OF THE INVENTION

A first aspect of the disclosure provides an apparatus comprising: at least one sensor inserted in a stator, for measuring a tops-on clearance between a rotor blade tip and an inner surface of a stator while an upper stator shell, a rotor, a lower stator shell are assembled together, and a tops-off clearance between the rotor blade tip and the inner surface of a stator while the lower stator shell and a rotor are assembled together; and a computing device operably connected with the at least one sensor for determining a tops-on/tops-off shift, wherein the tops-on/tops-off shift is a difference between the tops-on clearance and the tops-off clearance.

A second aspect of the disclosure provides a turbomachine comprising: a rotor; and a stator surrounding the rotor, the stator including a lower stator shell and an upper stator shell. At least one sensor is inserted in the lower stator shell, for measuring a tops-on clearance between a rotor blade tip and an inner surface of the stator while the upper stator shell, the rotor, and the lower stator shell are assembled together, and a tops-off clearance between the rotor blade tip and the inner surface of the stator while the lower stator shell and the rotor are assembled together; and a computing device is operably connected with the at least one sensor for determining a tops-on/tops-off shift, wherein the tops-on/tops-off shift is a difference between the tops-on clearance and the tops-off clearance.

A third aspect of the disclosure provides a method for assembling a turbomachine, comprising: using at least one sensor inserted in a stator, measuring a tops-on clearance between a rotor blade tip and an inner surface of a stator while an upper stator shell, a rotor, a lower stator shell are assembled together, and measuring a tops-off clearance between the rotor blade tip and the inner surface of a stator while the lower stator shell and a rotor are assembled together; determining a tops-on/tops-off shift, wherein the tops-on/tops-off shift is a difference between the tops-on clearance and the tops-off clearance; assembling the lower stator shell; placing the rotor on the lower stator shell at a position shifted from a desired rotor position by a distance equal to the tops-on/tops-off shift; and assembling the upper stator shell to the lower stator shell.

These and other aspects, advantages and salient features of the invention will become apparent from the following detailed description, which, when taken in conjunction with the annexed drawings, where like parts are designated by like reference characters throughout the drawings, disclose embodiments of the invention.

DETAILED DESCRIPTION OF THE INVENTION

At least one embodiment of the present invention is described below in reference to its application in connection with the operation of a turbomachine. Although embodiments of the invention are illustrated relative to a turbomachine in the form of a steam turbine, it is understood that the teachings are equally applicable to other turbomachines, including but not limited to gas turbines. Further, at least one embodiment of the present invention is described below in reference to a nominal size and including a set of nominal dimensions. However, it should be apparent to those skilled in the art that the present invention is likewise applicable to any suitable turbine and/or generator. Further, it should be apparent to those skilled in the art that the present invention is likewise applicable to various scales of the nominal size and/or nominal dimensions.

Figure 9:
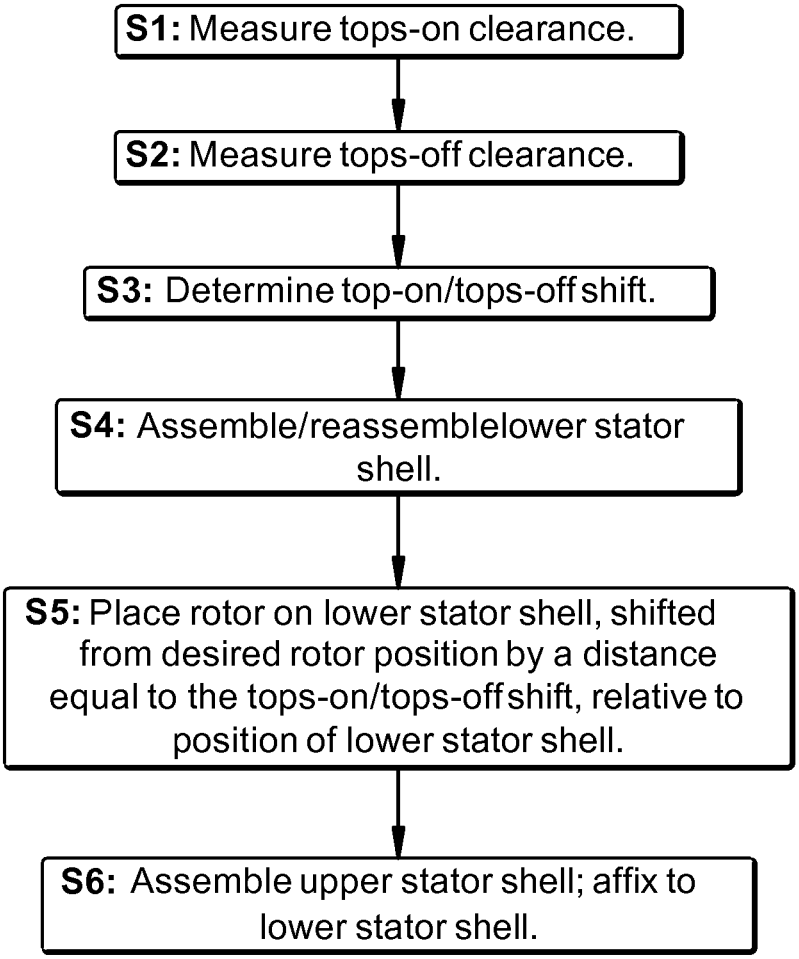
FIG. 9 is a flow chart depicting a method in accordance with an embodiment of the invention.

As indicated above, FIGS. 1-8 depict, and aspects of the invention provide, an apparatus for measuring deflection, and FIG. 9 depicts a method for assembling a turbomachine using the same.

Figure 1:
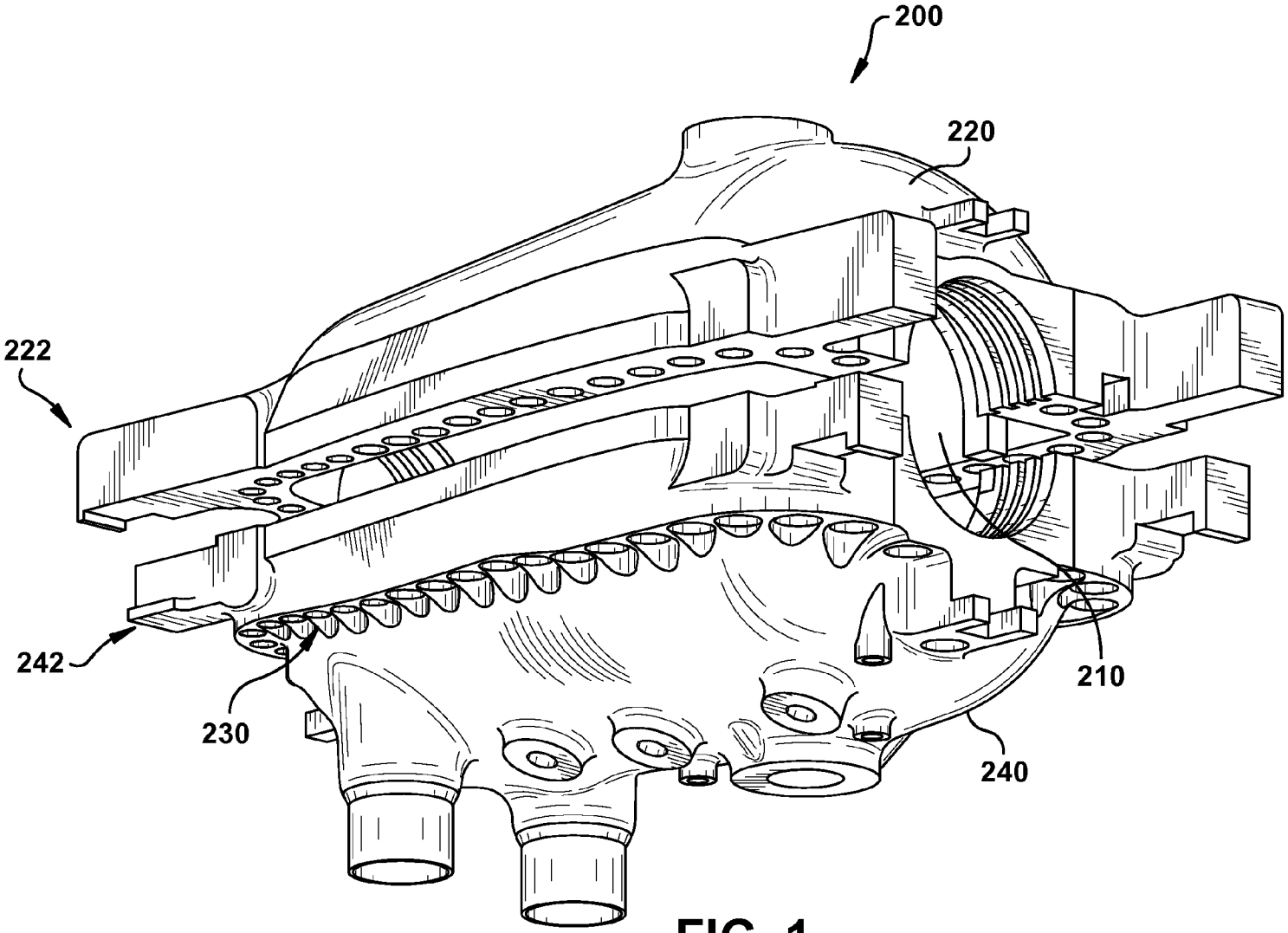
FIG. 1 shows an exploded perspective view of an upper and lower shell of a stator.
Figure 2:
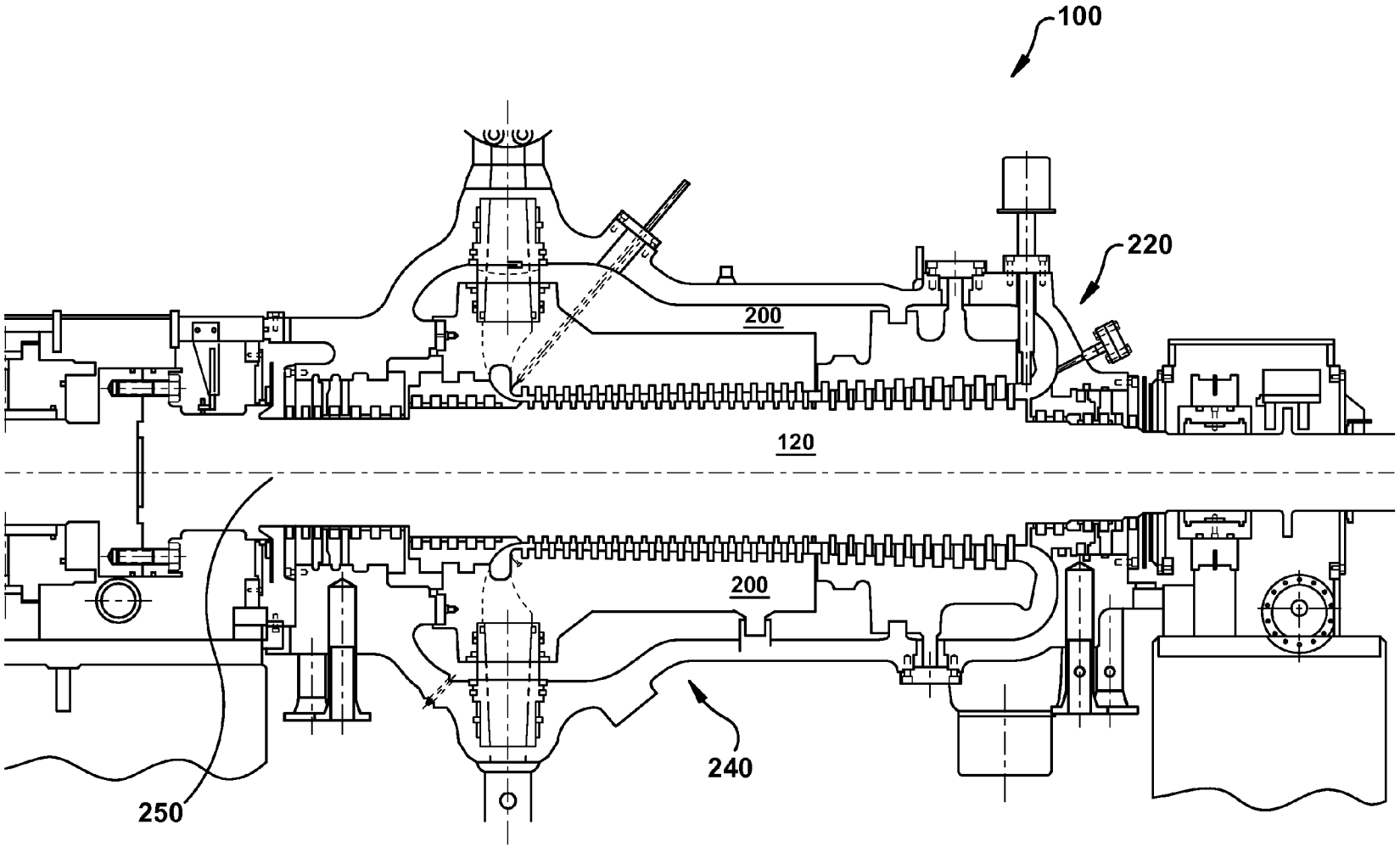
FIG. 2 shows a cross sectional schematic view of a turbomachine.

FIGS. 1-2 show different aspects of turbine 100 (labeled in FIG. 2) in accordance with embodiments of the disclosure. FIG. 1 shows an exploded perspective view of an outer shell of stator 200, which includes upper stator shell 220 and lower stator shell 240. Upper stator shell 220 includes an upper stator shell arm 222; lower stator shell 240 likewise includes lower stator shell arm 242. As shown in FIG. 2, stator 200 surrounds rotor 120, which rotates about a longitudinal axis 250 within stator 200.

Figure 3:
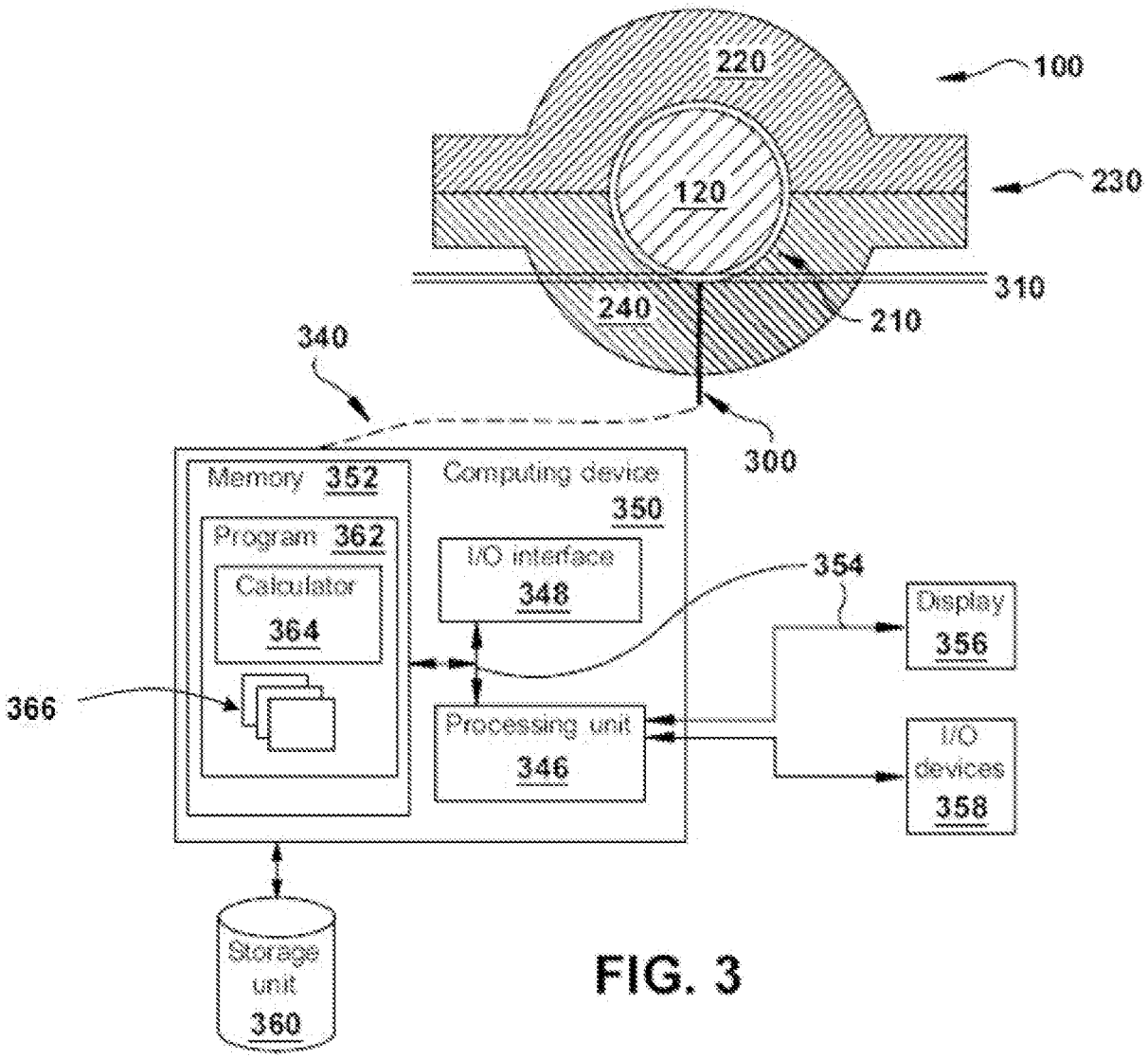
FIG. 3 shows a cross sectional representation of a turbomachine in the tops-on condition in accordance with an embodiment of the invention.
Figure 4:
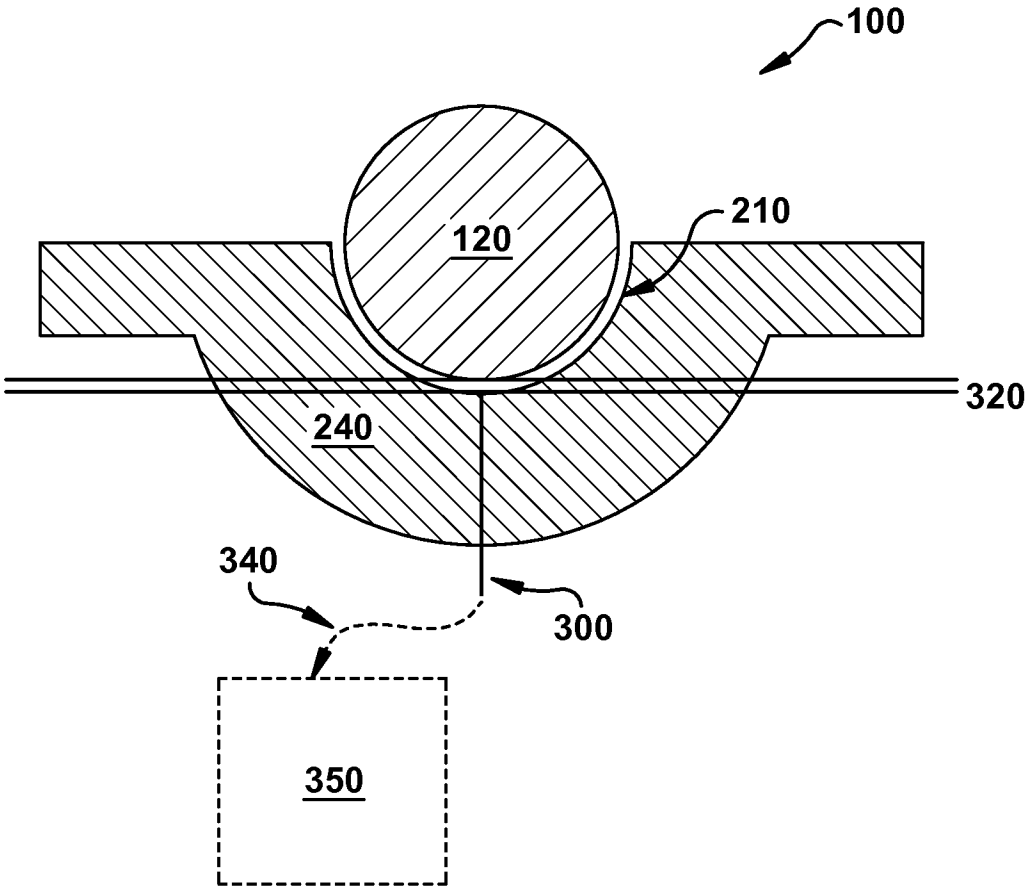
FIG. 4 shows a cross sectional representation of a turbomachine in the tops-off condition in accordance with an embodiment of the invention.
Figure 5:
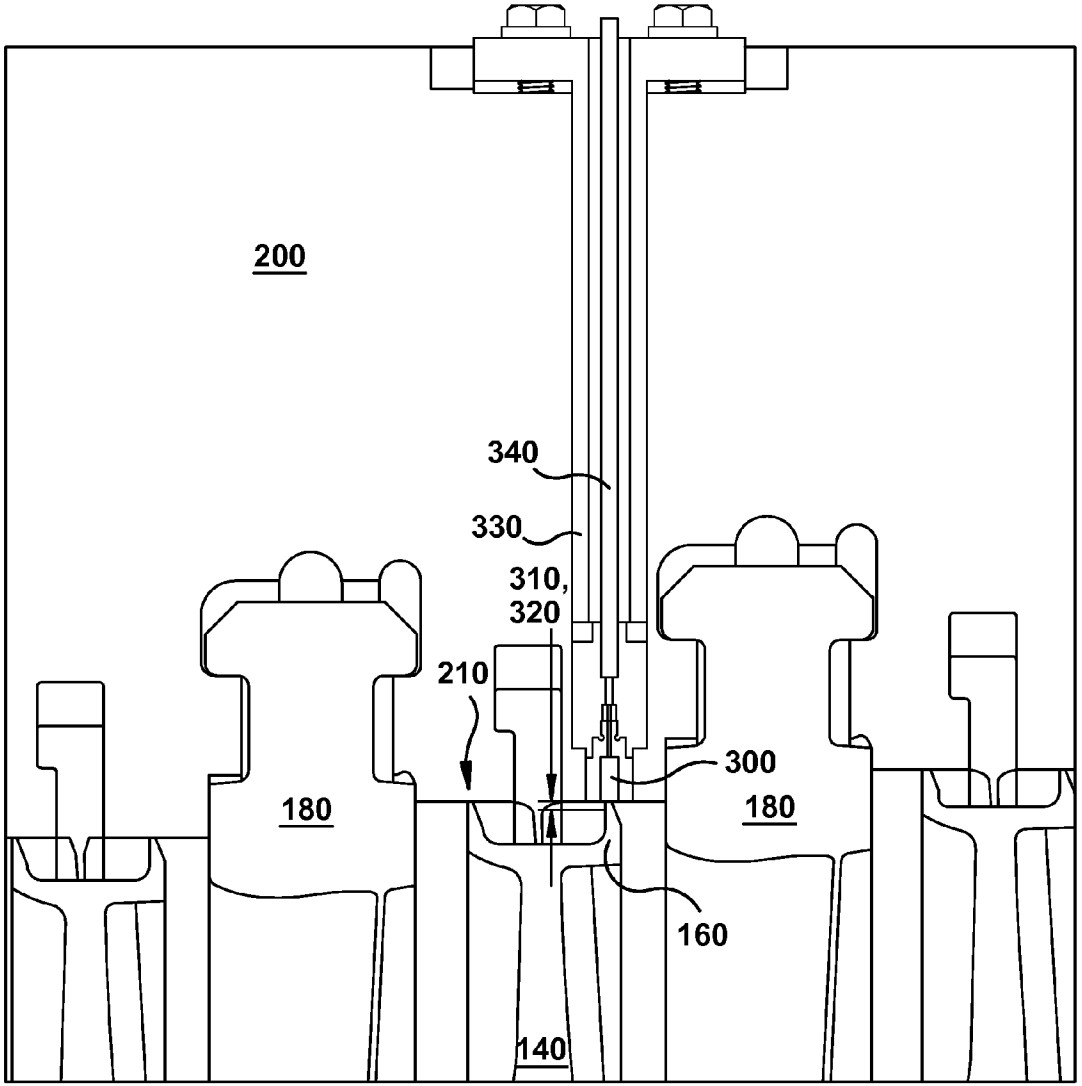
FIG. 5 shows a cross sectional view of a rotor-to-stator clearance distance in accordance with an embodiment of the invention.

As shown in FIG. 3, lower stator shell 240 includes at least one clearance sensor 300 inserted therein. Clearance sensor 300 may be inserted in lower stator shell 240 such that clearance sensor 300 is embedded in lower stator shell 240 with a radially outer edge of clearance sensor 300 substantially flush with an inner surface 210 of the stator 200. In some embodiments, as shown in FIGS. 3-4, clearance sensor 300 is located at a bottom dead-center position in the lower shell 240 of stator 200. In other embodiments, clearance sensor 300 may be offset from a bottom dead center position by a margin of degrees which may be accounted for in calculations. Clearance sensor 300 is used for measuring clearances 310, 320 (FIGS. 3, 4 respectively) between a tip of blade 140 on rotor 120 (FIG. 5), i.e., the radially outermost point on rotor 120, and an inner surface 210 of stator 200. As shown in FIG. 5, the radially outermost point on rotor 120 blade 140 may be a blade seal tooth tip 160.

Figure 6:
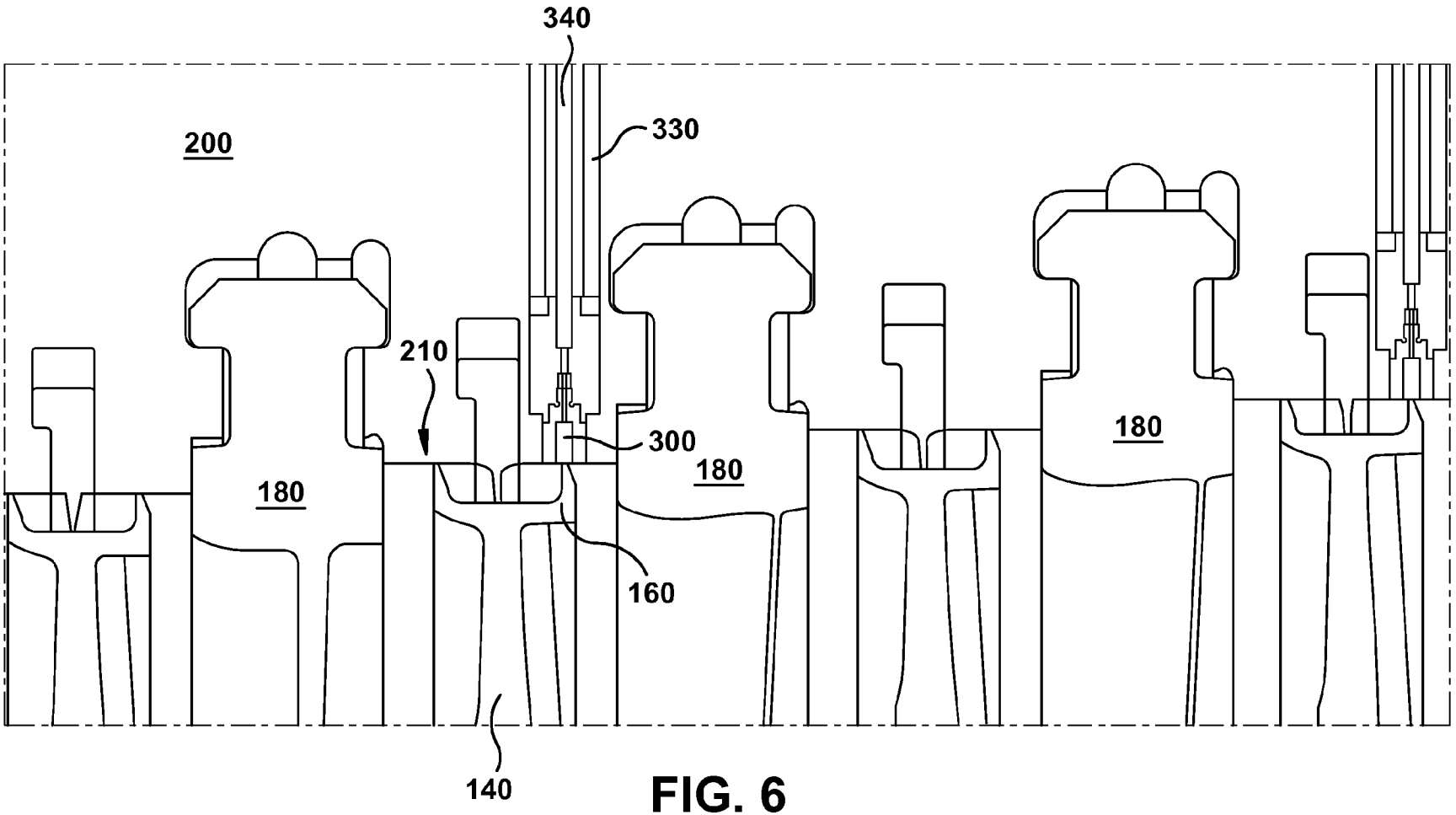
FIG. 6 shows a cross sectional view of a rotor-to-stator clearance distance in accordance with an embodiment of the invention.
Figure 8:
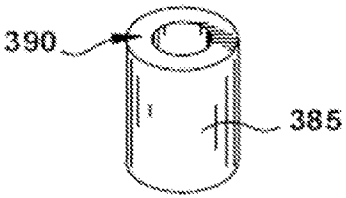
FIG. 8 shows a perspective view of a portion of clearance sensor retainer member in accordance with an embodiment of the invention.

In further embodiments, such as the embodiment shown in FIG. 6, clearance sensor 300 may comprise a plurality of clearance sensors 300. In the embodiment in FIG. 6, clearance sensors 300 are separated by two stages of blades. In other embodiments, between about 3 and about 6 clearance sensors 300 may be axially spaced along stator 200. In further embodiments, a plurality of clearance sensors 300 may be arranged such that one clearance sensor 300 is axially aligned with each of a plurality of stages of blades on rotor 120. In such an embodiment, the number of clearance sensors 300 may be equal to the number of stages of blades on rotor 120. In other arrangements, one clearance sensor 300 may be axially aligned with every other stage of blades on rotor 120, such that the number of clearance sensors 300 may be equal to half of the number of stages of blades on rotor 120. These arrangements are merely illustrative, however; other arrangements of clearance sensors 300 relative to stages of blades on rotor 120 are contemplated as other embodiments of the invention.

Figure 7:
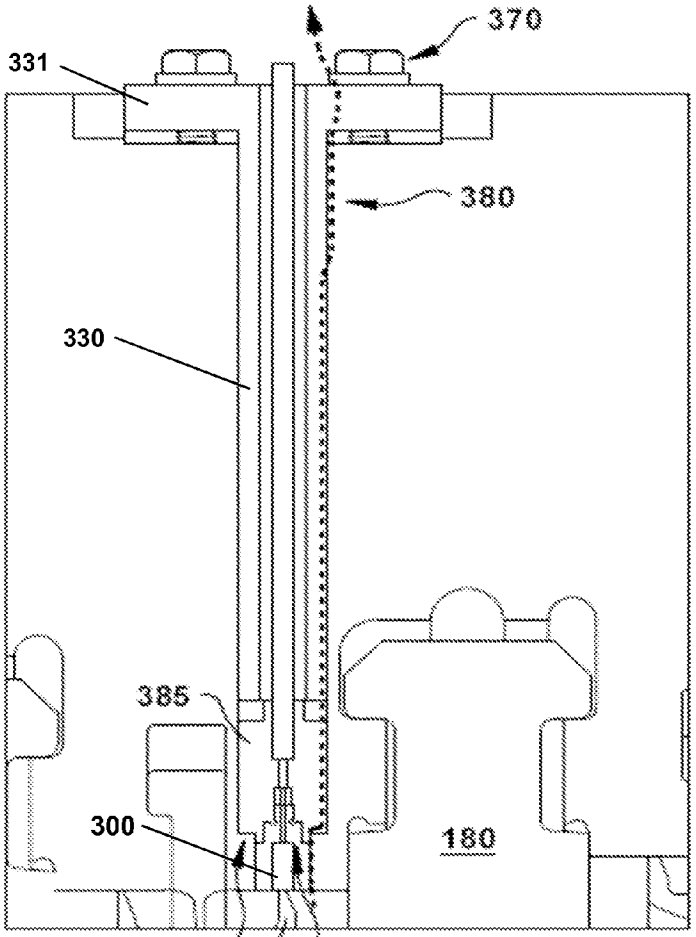
FIG. 7 shows a cross sectional view of a clearance sensor and a clearance sensor retainer member in accordance with an embodiment of the invention.

As further shown in FIG. 7, clearance sensor 300 may be mounted to stator 200 and held in place by means of sensor retainer member 330. Sensor retainer member 330 may be substantially tube-shaped, with a passageway therein for clearance sensor instrumentation leads 340, and a flange member 331 at a radially outward end relative to turbine 200. In some embodiments, sensor retainer member 330 may comprise a single member; in other embodiments sensor retainer member 330 may comprise two separate members, each including a semi-annular portion and portion of flange member 331 such that they can be inserted into stator 200 separately and joined together to position clearance sensor 300 and contain clearance sensor instrumentation leads 340. Bolts 370 may be used to affix flange member 331 of sensor retainer 330 to stator 200.

In order to avoid a potential steam leakage path 380 along sensor retainer member 330, clearance sensor 300 may be either permanently affixed in a manner that fully seals the interface (e.g., welded, brazed, cemented, etc.) or may be installed with enough contact surface area and contact force so as to prevent leakage along path 380. In the embodiment shown in FIGS. 7-8, substantially annularly shaped sealing member 385 includes surface 390, which acts as a sealing surface. Surface 390 is a substantially annularly shaped surface at the distal end, i.e., the end nearer clearance sensor 300.

A proximal end 305 of clearance sensor 300 mates with a surface 390 (FIG. 7), and the surfaces are forced together to prevent leakage of working fluid in the turbine. Retainer member 330 and the bolts 370 or other method of affixation provide the force necessary to ensure a proper seal. Force may also be applied using other types of springs or fluid systems, e.g., hydraulic or pneumatic. Gaskets or other sealing devices may also be used to provide a seal.

In embodiments in which turbine 100 is single-shell construction, the clearance sensor 300 may be embedded in the shell or the nozzle ring. In either case, the clearance sensor 300 and related hardware (including, e.g., sensor retainer member 330) would penetrate the shell. In embodiments in which turbine 100 has double-shell construction, the clearance sensor 300 could be embedded in the inner shell (or nozzle carrier), as shown here in FIG. 7, or in a nozzle outer ring. In such an embodiment, the inner shell would be penetrated by the clearance sensor 300 and related hardware, and clearance sensor instrumentation leads 340 would exit turbine 100 through an instrumentation port in the outer shell.

Referring back to FIG. 3, clearance sensor 300 may measure a tops-on clearance 310, which is the clearance between rotor 120 and inner surface 210 as measured while upper stator shell 220, rotor 120, and lower stator shell 240 are assembled together. Clearance sensor 300 may also measure tops-off clearance 320 (FIG. 4), which is the clearance between rotor 120 and inner surface 210 as measured while lower stator shell 240 and rotor 120 are assembled together. In some embodiments, clearance sensor 300 may be a voltage drop sensor, and may measure a voltage drop across a clearance 310, 320 between a tip of sensor 300 and a point on rotor 120. Other types of sensors, either now known or later developed, may also be used.

Clearance sensor 300 may further be in signal communication with computing device 350 via clearance sensor instrumentation leads 340. Upon measuring a clearance 310, 320, clearance sensor 300 may transmit a signal representing the clearance 310, 320 to computing device 350. As shown in FIG. 3, computing device 350 includes a processing unit 346, a memory 352, and input/output (I/O) interfaces 348 operably connected to one another by pathway 354, which provides a communications link between each of the components in computing device 350. Further, computing device 350 is shown in communication with display 356, external I/O devices/resources 358, and storage unit 360. I/O resources/devices 358 can comprise one or more human I/O devices, such as a mouse, keyboard, joystick, numeric keypad, or alphanumeric keypad or other selection device, which enable a human user to interact with computing device 350 and/or one or more communications devices to enable a device user to communicate with computing device 350 using any type of communications link. Computing device 350 is shown in phantom in FIG. 4 for purposes of brevity only.

In general, processing unit 346 executes computer program code 362 which provides the functions of computing device 350. Modules, such as shift calculator module 364, which is described further herein, are stored in memory 352 and/or storage unit 360, and perform the functions and/or steps of the present invention as described herein. Memory 352 and/or storage unit 360 can comprise any combination of various types of computer readable data storage media that reside at one or more physical locations. To this extent, storage unit 360 could include one or more storage devices, such as a magnetic disk drive or an optical disk drive. Still further, it is understood that one or more additional components not shown in FIG. 3 can be included in computing device 350. Additionally, in some embodiments one or more external devices 358, display 356, and/or storage unit 360 could be contained within computing device 350, rather than externally as shown, in the form of a computing device 350 which may be portable and/or handheld.

Computing device 350 can comprise one or more general purpose computing articles of manufacture capable of executing program code, such as program 362, installed thereon. As used herein, it is understood that "program code" means any collection of instructions, in any language, code or notation, that cause a computing device having an information processing capability to perform a particular action either directly or after any combination of the following: (a) conversion to another language, code or notation; (b) reproduction in a different material form; and/or (c) decompression. To this extent, program 362 can be embodied as any combination of system software and/or application software.

Further, program 362 can be implemented using a module such as shift calculator 364 or set of modules 366. In this case, calculator 364 can enable computing device 350 to perform a set of tasks used by program 362, and can be separately developed and/or implemented apart from other portions of program 362. As used herein, the term "component" means any configuration of hardware, with or without software, which implements the functionality described in conjunction therewith using any solution, while the term "module" means program code that enables a computing device 350 to implement the actions described in conjunction therewith using any solution. When fixed in memory 352 or storage unit 360 of a computing device 350 that includes a processing unit 346, a module is a substantial portion of a component that implements the actions. Regardless, it is understood that two or more components, modules, and/or systems may share some/all of their respective hardware and/or software. Further, it is understood that some of the functionality discussed herein may not be implemented or additional functionality may be included as part of computing device 350.

When computing device 350 comprises multiple computing devices, each computing device can have only a portion of program 362 fixed thereon (e.g., one or more modules 364, 366). However, it is understood that computing device 350 and program 362 are only representative of various possible equivalent computer systems that may perform a process described herein. To this extent, in other embodiments, the functionality provided by computing device 350 and program 362 can be at least partially implemented by one or more computing devices that include any combination of general and/or specific purpose hardware with or without program code, including but not limited to a handheld measuring device for stator-to-rotor clearance. In each embodiment, the hardware and program code, if included, can be created using standard engineering and programming techniques, respectively.

When computing device 350 includes multiple computing devices, the computing devices can communicate over any type of communications link. Further, while performing a process described herein, computing device 350 can communicate with one or more other computer systems using any type of communications link. In either case, the communications link can comprise any combination of various types of wired and/or wireless links; comprise any combination of one or more types of networks; and/or utilize any combination of various types of transmission techniques and protocols.

As noted, computing device 350 includes a shift calculator module 364 for analyzing a signal provided by clearance sensor 300. Using a signal from clearance sensor 300 representing a tops-on clearance 310 and a signal representing tops-off clearance 320, shift calculator module 364 may calculate a tops-on/tops-off shift. The tops-on/tops-off shift is equal to the difference between tops-on clearance 310 and tops-off clearance 320, and represents the shift in position attributable to installing upper stator shell 220 to lower stator shell 240.

Tops-on clearance 310 may be measured when turbomachine 100 is shutdown and cool. In further embodiments, rotor 120 may be rotated on a turning gear during measurement of tops-on clearance 310. This allows clearance 310 to account for any variations in clearance related to variations in radially extending length of blades on rotor 120. When measuring tops-off clearance 320, a motor such as, e.g., an air motor, may be used to rotate rotor 120 for the same purpose. During measurement of tops-off clearance 320, rotor 120 is rotated slowly. For example, rotor 120 may be rotated at a speed of one half of a rotation per minute.

The measurements of tops-on clearance 310 and tops-off clearance 320 as described above may be used in a method for assembling a turbomachine 100. Referring to FIG. 9, in step S1, using clearance sensor (or sensors) 300 inserted in lower stator shell 240 of stator 200, tops-on clearance 310 may be measured while upper stator shell 220, rotor 120, a lower stator shell 240 are assembled together (FIG. 3). In step S2, tops-off clearance 320 may be measured while lower stator shell 240 and rotor 120 are assembled together (FIG. 4). It is noted that steps S1 and S2 may be performed with either step S1 prior to S2, or the reverse, with step S2 prior to step S1.

In step S3, using computing device 350, including shift calculator module 364 as described above, a tops-on/tops-off shift may be determined. The tops-on/tops-off shift is equal to the difference between tops-on clearance 310 and tops-off clearance 320.

Where, for example, turbomachine 100 had been disassembled for maintenance and/or repair, it may be reassembled by first assembling lower stator shell 240 (step S4), and placing rotor 120 on lower stator shell 240 (step S5). As discussed above, however, rotor 120 is not placed such rotor 120 is in the desired rotor position relative to lower stator shell 240, i.e., tops-off clearance 320 is not equal to the clearance that results in maximal efficiency of turbomachine 100. Rather, rotor 120 is placed in position relative to lower stator shell 240 such that it is shifted from the desired rotor position by a distance equal to the tops-on/tops-off shift. Where a plurality of clearance sensors 300 are used, the relative positions of rotor 120 and lower stator shell 240 are adjusted such that at each axial location of a clearance sensor 300, rotor 120 is shifted by the tops-on/tops-off shift as described above.

Adjustments in the relative positions of rotor 120 and lower stator shell 240 in order to achieve the appropriate shift from the desired rotor position may be made in a variety of ways. In one embodiment, the position of rotor 120 may be adjusted relative to lower stator shell 240 in accordance with the tops-on/tops-off shift. Such manipulation of rotor 120 may be accomplished by, e.g., adjusting the rotor bearings. In another embodiment, lower stator shell 240 may be adjusted. Lower stator shell 240 may be manipulated by, e.g., shimming or adjusting stator components including but not limited to nozzles 180 and other stator components. Each nozzle stage 180 (see FIGS. 5-7) may be individually adjustable. Where nozzles 180 are not individually adjustable, a best fit may be used, based on measured data from clearance sensor 300.

In step S6, upper stator shell 220 is assembled to lower stator shell 240. As the weight of upper stator shell 220 is added, and horizontal joint 230 between upper and lower stator shells 220, 240 is affixed by, e.g., bolts at horizontal joint 230, rotor 120 is shifted such that it is positioned relative to inner surface 210 of stator 200 such that when operated, it will produce maximal efficiency without impacting inner surface 210 of stator 200.

As previously mentioned and discussed further herein, the apparatus for measuring deflection, including clearance sensor 300, has the technical effect of enabling measurement of the tops-on clearance 310 and tops-off clearance 320 between rotor 120 and stator using clearance sensor 300. Using the measured tops-on 310 and tops-off 320 clearances, a tops-on/tops-off shift can be calculated. This tops-on/tops-off shift may be used to assemble or re-assemble turbomachine 100 by placing rotor 120 on lower stator shell 240, shifted from the desired position (relative to lower stator shell 240) by a distance equal to the tops-on/tops-off shift. When upper stator shell 220 is affixed to lower stator shell 240, the resulting rotor 120 position will be as desired. It is understood that some of the various components shown in FIG. 3 can be implemented independently, combined, and/or stored in memory for one or more separate computing devices that are included in computing device 350.

As used herein, the terms "first," "second," and the like, do not denote any order, quantity, or importance, but rather are used to distinguish one element from another, and the terms "a" and "an" herein do not denote a limitation of quantity, but rather denote the presence of at least one of the referenced item. The modifier "about" used in connection with a quantity is inclusive of the stated value and has the meaning dictated by the context (e.g., includes the degree of error associated with measurement of the particular quantity). The suffix "(s)" as used herein is intended to include both the singular and the plural of the term that it modifies, thereby including one or more of that term (e.g., the metal(s) includes one or more metals). Ranges disclosed herein are inclusive and independently combinable (e.g., ranges of "up to about 6, or, more specifically, about 3 to about 6 sensors," is inclusive of the endpoints and all intermediate values of the ranges of "about 3 to about 6," etc.).

While various embodiments are described herein, it will be appreciated from the specification that various combinations of elements, variations or improvements therein may be made by those skilled in the art, and are within the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for assembling a turbomachine, comprising:

measuring a tops-on clearance between a rotor blade tip and an inner surface of a stator while an upper stator shell and a lower stator shell are assembled together, and a rotor is installed within an assembled stator;

measuring a tops-off clearance between the rotor blade tip and the inner surface of a stator while the lower stator shell and the rotor are assembled together, and the upper stator shell is not affixed to the lower stator shell;

determining a tops-on/tops-off shift, wherein the tops-on/tops-off shift is equal to a difference between the tops-on clearance and the tops-off clearance;

assembling the lower stator shell;

placing the rotor on the lower stator shell;

adjusting a relative position of the stator and the rotor such that the rotor is offset from a desired rotor position relative to the stator by a distance equal to the tops-on/tops-off shift; and assembling the upper stator shell to the lower stator shell to form the assembled stator;

wherein the measuring the tops off-clearance and the measuring the tops-on clearance is performed using a plurality of sensors and wherein the plurality of sensors are spaced such that either:

one sensor is axially aligned with each of a plurality of stages of motor blades, or one sensor is axially aligned with every other stage of the plurality of stages of rotor blades.

2. The method of claim 1, wherein the plurality of sensors further comprises between about 3 and about 6 sensors axially spaced along the stator.

3. The method of claim 1, wherein the measuring the tops-on clearance and the measuring the tops-off clearance further comprise measuring a voltage drop across a clearance between a tip of the sensor and a point on the rotor.

* * * * *

UNITED STATES PATENT AND TRADEMARK OFFICE

CERTIFICATE OF CORRECTION

PATENT NO. : 8,876,460 B2
APPLICATION NO. : 13/207536
DATED : November 4, 2014
INVENTOR(S) : Fred Thomas Willett, Jr.

It is certified that error appears in the above-identified patent and that said Letters Patent is hereby corrected as shown below:

In the Claims

In Column 8, line 56

Delete:
"motor blades"

Insert:
-- rotor blades --

Signed and Sealed this
Tenth Day of February, 2015

Michelle K. Lee

Michelle K. Lee
*Deputy Director of the United States Patent and Trademark Office*